United States Patent [19]

Malesko et al.

[11] Patent Number: 4,979,384

[45] Date of Patent: Dec. 25, 1990

[54] TRUNK LID LOCK WITH REMOTE RELEASE

[75] Inventors: Michael W. Malesko, Utica; Ellsworth S. Miller, Rochester; Michael Slavin, Caseville; Peter J. Henning, Pontiac, all of Mich.; Rodney Hayden, Ontario, Canada; Charles R. Martus, Troy, Mich.

[73] Assignee: Lectron Products, Inc., Rochester Hills, Mich.

[21] Appl. No.: 436,927

[22] Filed: Nov. 13, 1989

Related U.S. Application Data

[63] Continuation of Ser. No. 100,237, Sep. 23, 1987, abandoned.

[51] Int. Cl.[5] ..... E05B 65/19

[52] U.S. Cl. ..... 70/241; 70/279; 292/201; 292/216

[58] Field of Search ..... 70/240, 241, 279; 292/201, 216, DIG. 43

[56] References Cited

U.S. PATENT DOCUMENTS

| | | | |
|---|---|---|---|
| 3,016,968 | 1/1962 | Lenz et al. | 292/201 X |
| 3,572,068 | 3/1971 | Carlson | 70/241 |
| 3,620,560 | 11/1971 | Peters | 292/216 X |
| 3,643,479 | 2/1972 | Solow | 70/241 |
| 3,664,698 | 5/1972 | Stropkay | 292/201 |
| 3,785,186 | 1/1974 | James et al. | 292/216 X |
| 3,848,907 | 11/1974 | Shiurila | 292/201 X |
| 4,073,170 | 2/1978 | Miyabayashi et al. | 292/DIG. 43 X |
| 4,088,354 | 5/1978 | Kolendowicz | 292/216 X |
| 4,194,377 | 3/1980 | Maeda | 292/216 X |
| 4,268,076 | 5/1981 | Itoi | 70/279 X |
| 4,441,345 | 4/1984 | Guarr | 70/240 |
| 4,468,941 | 9/1984 | Bascou | 70/241 |
| 4,597,598 | 7/1986 | Bascou | 70/241 X |
| 4,624,491 | 11/1986 | Vincent | 70/279 X |
| 4,667,990 | 5/1987 | Quantz | 70/241 X |
| 4,671,548 | 6/1987 | Haberle et al. | 292/DIG. 43 X |

FOREIGN PATENT DOCUMENTS

| | | | |
|---|---|---|---|
| 2651038 | 5/1978 | Fed. Rep. of Germany | 70/240 |
| 3132535 | 3/1983 | Fed. Rep. of Germany | 70/240 |
| 3207718 | 9/1983 | Fed. Rep. of Germany | 292/DIG. 43 |
| 3447142 | 4/1986 | Fed. Rep. of Germany | 70/279 |

*Primary Examiner*—Gary L. Smith
*Assistant Examiner*—Suzanne L. Dino
*Attorney, Agent, or Firm*—Harness, Dickey & Pierce

[57] ABSTRACT

An improved deck lid lock with remote release for motor vehicles. The deck lid lock employs a solenoid operated rotatable armature which acts directly on a leg of a rotatable latch plate which engages a lock bar. On energization of the solenoid, the armature is attracted to the solenoid causing it to disengage the latch plate so that the deck lid may be opened. When the deck lid is closed, the lock bar is engaged by the latch plate which is returned to its normal latched position in engagement with the armature. The deck lid lock further includes a rotatable key cam which acts on the armature to enable release of the deck lid through conventional external key actuation.

21 Claims, 3 Drawing Sheets

TRUNK LID LOCK WITH REMOTE RELEASE

This is a continuation of U.S. patent application Ser. No. 100,237, filed Sept. 23, 1987 and now abandoned.

BACKGROUND AND SUMMARY OF THE INVENTION

This invention relates to a remote mechanical release mechanism and particularly to one adapted for releasing the deck (i.e. trunk) lid of a passenger car motor vehicle.

As a convenience feature, motor vehicle manufacturers often equip their products with remote release mechanisms for the vehicle's trunk lid. This feature enables the trunk lid to be released from inside the passenger compartment so that the driver does not have to remove the keys from the ignition and exit the vehicle to unlatch the deck lid externally. Various designs for such devices are presently known. Although remote release mechanisms according to the prior art perform satisfactorily, there is a continuing desire to reduce their complexity, size and cost, while providing acceptable operating and durability characteristics.

In accordance with the present invention, an improved deck lid lock with remote release is provided which is compact and has very few moving parts as compared with many designs according to the prior art. The simplicity of the subject device is achieved, in part, through combining the functions of a solenoid armature and a release latch element into a single multifunctional component.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE INVENTION

Figure 1:
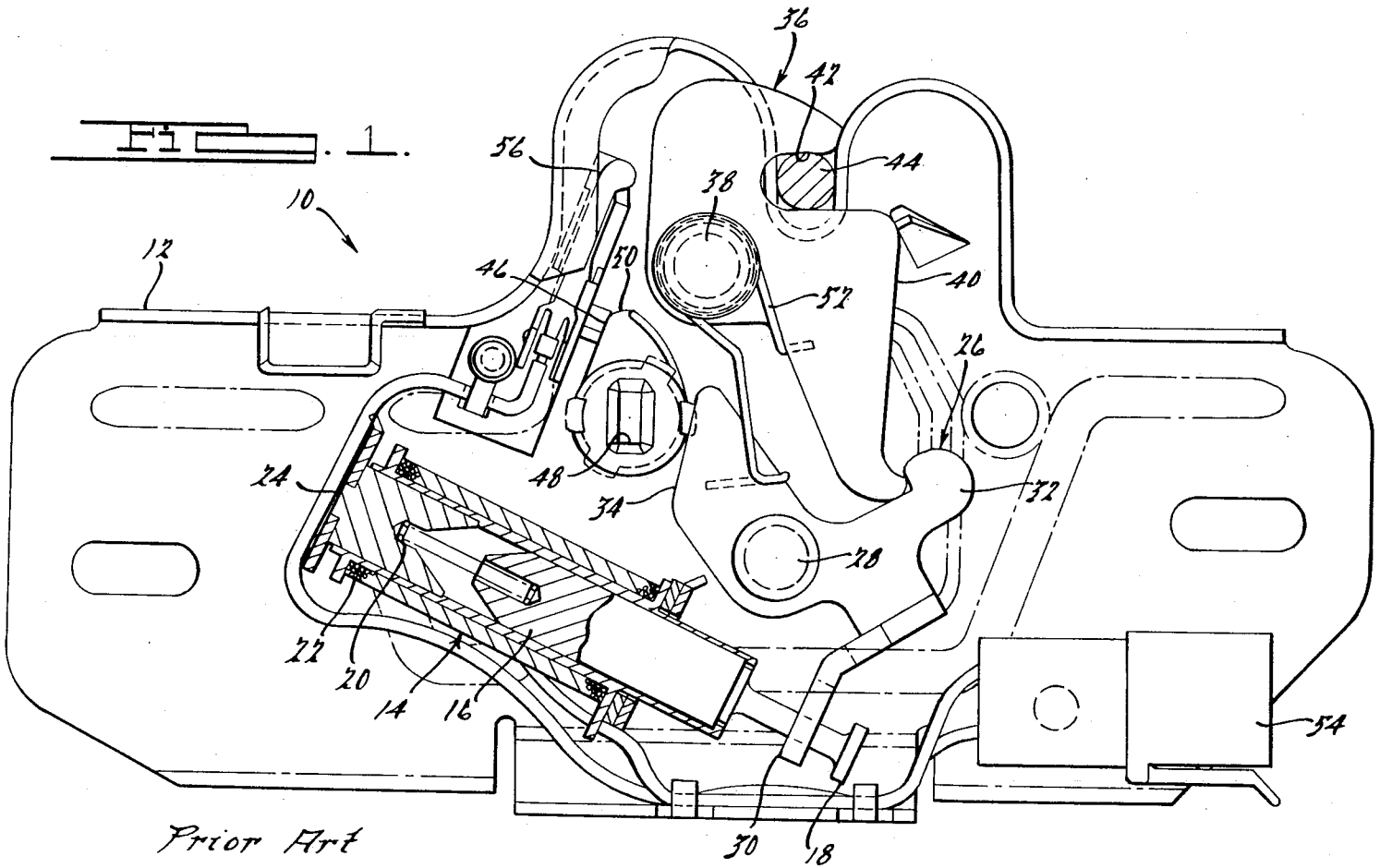
FIG. 1 is a side-elevational view of a deck lid lock with remote release according to a prior art design.

FIG. 1 illustrates a deck lid lock with remote release according to a prior art design which is designated by reference number 10. Lock 10 is illustrated herein to provide a background for describing the advantages of the design according to the present invention. Lock 10 includes base plate 12 which supports the remaining components of the lock. Base plate 12 is mounted to either the deck lid or the vehicle body, depending on the particular application. Solenoid assembly 14 includes a longitudinally movable armature 16 having a radially flared head 18. Spring 20 biases armature 16 to the extended position as shown in FIG. 1. In accordance with conventional design practices, the application of current to windings 22 of solenoid assembly 14 causes armature 16 to be attracted to pole piece 24, and overcomes the biasing force applied by spring 20. Latch dog 26 is rotatable about pin 28 and includes arm 30 which is engaged by head 18 upon retraction of armature 16. Latch dog 26 further includes hook-shaped arm 32 and arm 34.

Deck lid lock latch plate 36 is rotatable about pin 38 and includes an elongated arm 40 which engages the hooked portion of latch dog arm 32, as shown in FIG. 1, and also includes notch 42 which engages lock bar 44 affixed to the vehicle deck lid (or the vehicle rear compartment structure). Key cam 46 is journaled for rotation within base plate 12 and includes a central slot 48 which receives a similarly shaped bar which extends from the deck lid lock cylinder (not shown). Key cam 46 includes a projecting cam tab 50 which acts on latch dog arm 34 when key cam 46 is rotated clockwise from the position shown in FIG. 1. Torsion spring 52 is wrapped around pin 38 and has ends engaging latch plate 36 and latch dog 26, urging both of them to rotate in a counterclockwise direction.

FIG. 1 illustrates the orientation and cooperation of the elements of lock 10 when the deck lid is in a closed and locked condition. Latch plate 36 is maintained in the position shown through engagement between latch plate arm 40 and latch dog arm 32. When it is desired to release the deck lid remotely, voltage is applied to conductors communicating with winding 22 thus energizing the solenoid and causing armature 16 to be retracted. This movement causes engagement between head 18 and latch dog arm 30, urging latch dog 26 to rotate in a clockwise direction. This motion releases latch plate arm 40 enabling it to rotate in a counterclockwise direction until lock bar 44 is released, and thus enabling the deck lid to be opened.

When the deck lid is closed, lock bar 44 acts on latch plate 36 causing arm 40 to re-engage latch dog arm 32, thus returning the components to the orientation shown in FIG. 1. When the user releases the deck lid externally using a key, key cam 46 is rotated which causes cam tab 50 to engage latch dog arm 34 which in turn causes latch dog 26 to rotate clockwise, thus releasing latch plate 36, as previously explained.

FIG. 1 further illustrates additional components which are conventionally provided with deck lid lock 10, such as electrical connector 54 enabling convenient connection to the vehicle wiring harness. Lock condition switch 56 is used to provide a warning that the deck lid is in a released condition which is indicated through contact between an element of the switch and latch plate 36 when the plate is rotated to its counterclockwise (released) position.

Figure 2:
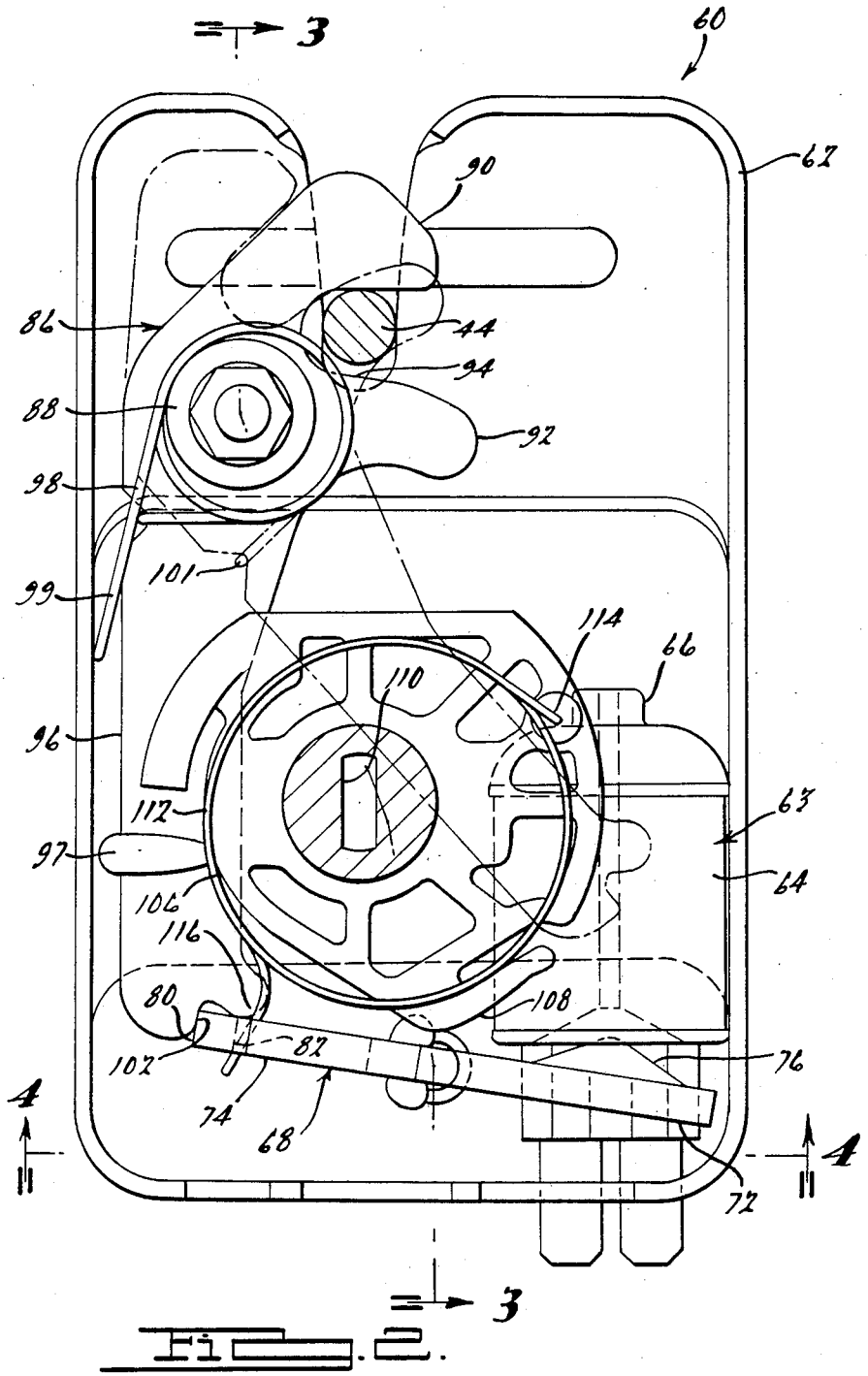
FIG. 2 is a side-elevational view of an improved deck lid lock with remote release according to the present invention which is partially cut away showing the various internal components thereof.
Figure 4:
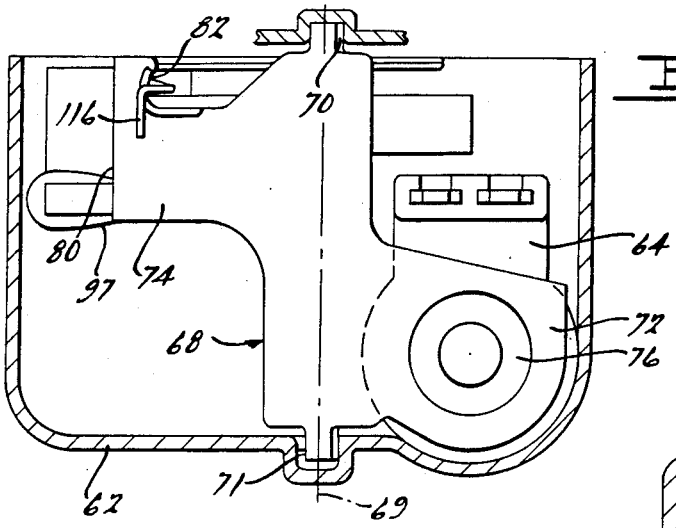
FIG. 4 is a partial cross-sectional view taken along lines 4—4 of FIG. 2.
Figure 3:
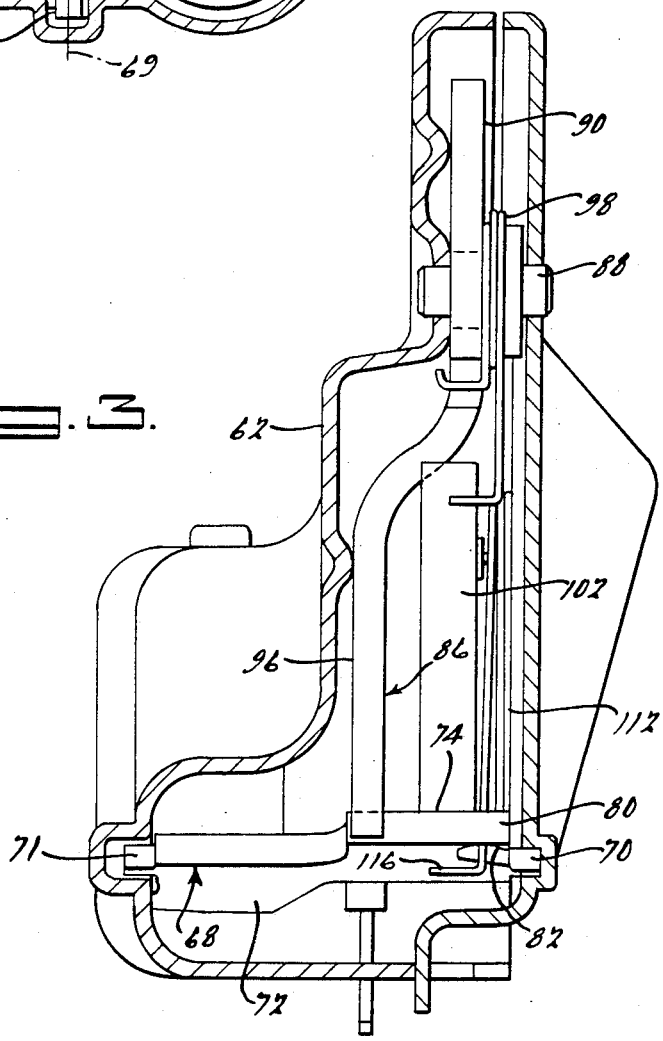
FIG. 3 is a cross-sectional view taken along lines 3—3 of FIG. 2.

Now with reference to FIGS. 2 through 4, an improved deck lid lock with remote release according to the present invention is shown which is generally designated by reference number 60. Lock 10 may be affixed to the vehicle's rear compartment structure to engage lock bar 44 attached to the deck lid, or the positioning of these components may be reversed, depending on the application. Deck lid lock 60 includes base plate 62 which forms a structural support for the remaining components of the lock. Solenoid 63 includes windings 64 which surrounds pole piece 66 which is rigidly affixed to base plate 62.

Armature 68 is pivotable about pivot axis 69 defined by projecting tabs 70 and 71, and is movable from its normal position shown in FIG. 2, to a counterclockwise displaced release position. Armature 68 includes a pair of legs 72 and 74 which are disposed about opposite sides of the pivot axis 69. Legs 72 and 74 are designed such that they provide a center of gravity location for armature 68 which is at or near axis 69. This balancing renders lock 60 relatively insensitive to inertial inputs which has been found to produce inadvertent lock release in some lock designs. Leg 72 defines dimple 76 which cooperates with pole piece 66 to define a tapered working air gap. Armature leg 74 defines engaging edge 80 and spring engaging notch 82.

Latch plate 86 is rotatable about pin 88 between the normal engaged position shown in full lines in FIG. 2, and the released position shown in phantom lines. Latch plate 86 has a pair of legs 90 and 92 defining notch 94 which traps lock bar 44, as previously explained in conjunction with the prior art structure shown in FIG. 1. Arm 96 engages armature engaging edge 80 when armature 68 is in the position shown in FIG. 2. Energy absorber 97 is made from an elastomer and is carried by latch plate arm 96 and contacts the side surface of base plate 62 when the arm moves at high velocity from the phantom line position to the full line position. Torsion spring 98 has extending arms 99 and 101 which engage base plate 62 and latch plate 86 respectively to bias the latch plate in the counterclockwise direction about pin 88. Latch plate arm 96 defines a lower notch 102 engagable with armature engaging edge 80.

Key cam 106 is journaled for rotation within base plate 62 and includes a radially projecting cam tab 108 and rectangularly-shaped slot 110 which engages a similarly shaped rod extending from the trunk lid lock cylinder (not shown). Torsion spring 112 wraps around key cam 106 and engages the key cam at end 114. Spring end 116 projects into and engages spring engaging notch 82, thus biasing key cam 106 in a counterclockwise direction and armature 68 in a clockwise direction.

FIG. 2 illustrates (in the full-line position of latch plate 86) the orientation and cooperation of elements when the deck lid is closed and locked. In that condition, latch plate 86 engages lock bar 44 and is maintained in the position shown through engagement between latch plate notch 102 and armature engaging edge 80. When it is desired to release the deck lid remotely, voltage is applied to windings coil 64, causing armature 68 to be attracted toward pole piece 66. This attraction causes armature 68 to overcome the biasing force applied by spring 112, thus moving the armature to its counterclockwise position. Upon this movement of armature 68, it becomes disengaged from latch plate arm 96, enabling the arm to rotate in a counterclockwise direction in response to the biasing applied by spring 98. When latch plate 86 reaches the phantom-line position shown in FIG. 2, lock bar 44 is released which enables the deck lid to be opened.

Release of the deck lid through external actuation of the latch cylinder causes key cam 106 to rotate in a clockwise direction such that cam tab 108 acts directly on armature 68, moving it counterclockwise to a position to release latch plate arm 96.

When the deck lid is closed, downward motion of lock bar 44 acts on latch plate legs 90 and 92, urging latch plate 86 to rotate in a clockwise direction. When latch plate arm 96 engages the upper surface of leg 74, the armature is moved counterclockwise against the urging of spring 112. Continued rotation causes latch plate notch 102 to engage armature engaging edge 80 causing the armature to return to the full-line position shown in FIG. 2. Energy absorber 97 serves to reduce the rebound velocity of arm 96 when it reaches its extreme clockwise position to ensure proper engagement with armature edge 80.

As is evident from the appended figures and above description, deck lid lock 60 is less complex and has fewer components than deck lid lock 10. This reduction in complexity is achieved primarily through the elimination of a separate latch dog element 26 shown in FIG. 1. Instead, armature 68 shown in FIG. 2 performs the functions of both latch dog 26 and armature 16 of the prior art structure shown in FIG. 1.

Deck lid lock 60 is very compact which is attributable to the dual function operation of armature 68 and due to the positioning of solenoid 63. Latch plate arm 96 is of a length dictated by the force output of solenoid 63, since the frictional engagement between armature edge 80 and latch plate notch 102 which must be overcome by the solenoid decreases with the length of the arm. Given that the arm 96 establishes a minimum size of lock 60, solenoid 63 is efficiently packaged adjacent latch plate 86 and on the same side of armature 89 as the latch plate.

While the above description constitutes the preferred embodiments of the present invention, it will be appreciated that the invention is susceptible to modification, variation and change without departing from the proper scope and fair meaning of the accompanying claims.

We claim:

1. A deck lid lock with remote release adapted to be mounted to a motor vehicle structure and engageable with a lock bar comprising:

a base plate;

a solenoid pole piece;

a solenoid winding magnetically coupled to said pole piece;

an armature fixed for rotation with respect to said base plate about a first pivot whereby energization of said winding causes said armature to rotate from a latched position to an unlatched position;

first spring means acting on said armature for urging said armature toward said latched position;

a latch plate rotatable about a second pivot from a latched to an unlatched position, said latch plate having an arm engageable with said armature when said armature is in said latched position, and free from engagement with said armature when said armature is in said unlatched position, said latch plate further forming a notch which captures the lock bar when said latch plate is in said latched position, and releases the lock bar when said latch plate is in said unlatched position;

a key cam rotatably carried by said base plate and having a projecting cam tab engageable with said armature to urge said armature to said unlatched position;

second spring means acting on said latch plate for biasing said latch plate toward said unlatched position whereby said armature may be moved to said unlatched position either by energization of said solenoid winding or by rotation of said key cam, thus enabling said latch plate to move the said unlatched position releasing the lock bar and wherein when said deck lid is closed, the lock bar urges said latch plate to return to said locked position causing said latch plate arm to re-engage said armature and energy absorbing means acting on said latch plate for absorbing the kinetic energy of said latch plate as said latch plate rotates from said unlatched to said latched positions.

2. The deck lid lock according to claim 1 wherein said energy absorber comprises an elastomeric body carried by said latch plate arm which contacts said base plate when said latch plate rotates from said unlatched to said latched positions.

3. A deck lid lock with remote release adapted to be mounted to a motor vehicle structure and engageable with a lock bar comprising:

a base plate;

a solenoid pole piece affixed to said base plate;

a solenoid winding surrounding said pole piece;

an armature fixed for rotation with respect to said base plate about a first pivot, said armature having a first leg overlying said pole piece on one side of said first pivot, and a second leg positioned on the opposite side of said first pivot such that the center of gravity of said armature is located adjacent said first pivot whereby energization of said winding causes said armature first leg to be attracted to said pole piece causing said armature to rotate from a latched position to an unlatched position;

first spring means acting on said armature second leg for urging said armature toward said latched position;

a latch plate rotatable about a second pivot from a latched to an unlatched position, said latch plate having an arm engageable with said armature second leg when said armature is in said latched position, and free from engagement with said armature when said armature is in said unlatched position, said latch plate further forming a notch which captures and restrains the lock bar when said latch plate is in said latched position and releases the lock bar when said latch plate is in said unlatched position;

a key cam rotatably carried by said base plate and having a projecting cam tab engageable with said armature to urge said armature second leg to said unlatched position;

second spring means acting on said latch plate for biasing said latch plate towards said unlatched position whereby said armature may be moved to said unlatched position either by energization of said solenoid winding or by rotation of said key cam, thus enabling said latch plate to move to said unlatched position releasing said lock bar, and wherein when said deck lid is closed, said lock bar urges said latch plate to return to said locked position causing said latch plate arm to re-engage said armature second leg; and energy absorbing means acting on said latch plate for absorbing the kinetic energy of said latch plate as said latch plate rotates from said unlatched to said latched positions.

4. The deck lid lock according to claim 3 wherein said energy absorber comprises an elastomeric body carried by said latch plate arm which contacts said base plate when said latch plate rotates from said unlatched to said latched positions.

5. A deck lid lock with remote release adapted to be mounted to a motor vehicle structure and engageable with a lock bar comprising:

a base plate;

a solenoid pole piece fixed with respect to said base plate;

a solenoid winding magnetically coupled to said pole piece;

an armature fixed for rotation with respect to said base plate about a first pivot whereby energization of said winding causes said armature to be magnetically attracted to said pole piece to rotate from a latched position wherein said armature is free from connection with said solenoid pole piece and said solenoid winding to an unlatched position;

first spring means acting on said armature for urging said armature toward said latched position;

a latch plate rotatable about a second pivot from a latched to an unlatched position, said latch plate having an arm engageable by direct contact with said armature when said armature is in said latched position, and free from engagement with said armature when said armature is in said unlatched position, said latch plate further forming a notch which contacts and captures the lock bar when said latch plate is in said latched position, and releases the lock bar when said latch plate is in said unlatched position;

a key cam rotatably carried by said base plate and having a projecting cam tab engageable with said armature to urge said armature to said unlatched position; and second spring means acting on said latch plate for biasing said latch plate toward said unlatched position whereby said armature may be moved to said unlatched position either by energization of said solenoid winding or by rotation of said key cam, thus enabling said latch plate to move to said unlatched position releasing the lock bar and wherein when said deck lid is closed, the lock bar urges said latch plate to return to said locked position causing said latch plate arm to re-engage said armature.

6. The deck lid lock according to claim 5 wherein said solenoid pole piece is affixed to said base plate.

7. The deck lid lock according to claim 5 wherein said armature defines an edge engageable with said latch plate.

8. The deck lid lock according to claim 5 wherein said first spring means includes a first coil spring wrapped around and engaging said key cam and further engaging said armature.

9. The deck lid lock according to claim 5 wherein said second spring means includes a second coil spring wrapper around said second pivot and having arms engaging said base plate and said latch plate.

10. The deck lid lock according to claim 5 further comprising energy absorbing means acting on said latch plate for absorbing the kinetic energy of said latch plate as said latch plate rotates from said unlatched to said latched positions.

11. The deck lid lock according to claim 10 wherein said energy absorber comprises an elastomeric body carried by said latch plate arm which contacts said base plate when said latch plate rotates from said unlatched to said latched positions.

12. The deck lid lock according to claim 5 wherein said armature includes a first leg adjacent said solenoid winding and a second leg engageable with said latch plate which are disposed on opposite sides of a pivot axis of said armature, said armature having its center of gravity along said pivot axis whereby said armature is balanced with respect to inertial inputs.

13. A deck lid lock with remote release adapted to be mounted to a motor vehicle structure and engageable with a lock bar comprising:

a base plate;

a solenoid pole piece affixed to said base plate and fixed with respect thereto;

a solenoid winding surrounding said pole piece;

an armature fixed for rotation with respect to said base plate about a first pivot, said armature having a first leg overlying said pole piece on one side of said first pivot, and a second leg positioned on the opposite side of said first pivot such that the center of gravity of said armature is located adjacent said first pivot whereby energization of said winding causes said armature first leg to armature to rotate from a latched position wherein said armature is free from connection with said solenoid pole piece and said solenoid winding to an unlatched position;

first spring means acting on said armature second leg for urging said armature toward said latched position;

a latch plate rotatable about a second pivot from a latched to an unlatched position, said latch plate having an arm engageable with said armature second leg when said armature is in said latched position, and free from engagement with said armature when said armature is in said unlatched position, said latch plate further forming a notch which captures and restrains the lock bar when said latch plate is in said latched position and releases the lock bar when said latch plate is in said unlatched position;

a key cam rotatably carried by said base plate and having a projecting cam tab engageable with said armature to urge said armature second leg to said unlatched position; and second spring means acting on said latch plate for biasing said latch plate towards said unlatched position whereby said armature may be moved to said unlatched position whereby either by energization of said solenoid winding or by rotation of said key cam, thus enabling said latch plate to move to said unlatched position releasing said lock bar, and wherein when said deck lid is closed, said lock bar urges said latch plate to return to said locked position causing said latch plate arm to re-engage said armature second leg.

14. The deck lid lock according to claim 13 wherein said armature second leg defines an edge engageable with said latch plate.

15. The deck lid lock according to claim 13 wherein said first spring means includes a first coil spring wrapped around and engaging said key cam and further engaging said armature second leg.

16. The deck lid lock according to claim 13 wherein said second spring means includes a second coil spring wrapped around said second pivot and having portions thereof engaging said base plate and said latch plate.

17. The deck lid lock according to claim 13 wherein said armature second leg defines a notch which captures a leg of said first coil spring.

18. The deck lid lock according to claim 13 wherein said armature is generally planar in shape defining a pair of face surfaces on opposite sides of said armature, and wherein said solenoid winding and said pole piece are positioned on the same side of said armature.

19. The deck lid lock according to claim 13 further comprising energy absorbing means acting on said latch plate for absorbing kinetic energy of said latch plate as said latch plate rotates from said unlatched to said latched positions.

20. The deck lid lock according to claim 19 wherein said energy absorber comprises an elastomeric body carried by said latch plate arm which contacts said base plate when said latch plate rotates from said unlatched to said latched positions.

21. The deck lid lock according to claim 13 wherein said armature includes a first leg adjacent said solenoid winding and a second leg engageable with said latch plate which are disposed on opposite sides of a pivot axis of said armature, said armature having its center of gravity along said pivot axis whereby said armature is balanced with respect to inertial inputs.

* * * * *

UNITED STATES PATENT AND TRADEMARK OFFICE

CERTIFICATE OF CORRECTION

PATENT NO. : 4,979,384

DATED : December 25, 1990

INVENTOR(S) : Michael W. Malesko et al.

It is certified that error appears in the above-identified patent and that said Letters Patent is hereby corrected as shown below:

Column 4, line 61, claim 1, "the" should be --to--.

Column 7, line 15, claim 13, after "to" (first occurrence), insert --be magnetically attracted to said pole piece causing said--.

Signed and Sealed this

Eleventh Day of August, 1992

*Attest:*

DOUGLAS B. COMER

*Attesting Officer*

*Acting Commissioner of Patents and Trademarks*